US005975954A

United States Patent [19]

Wu et al.

[11] Patent Number: 5,975,954

[45] **Date of Patent: *Nov. 2, 1999**

[54] UNIVERSAL SERIAL BUS RECEPTACLE ELECTRIC CONNECTOR

[75] Inventors: Kun-Tsan Wu, Tu-Chen; Song-Rong Chiou, Lin-Kou Ksiang, both of Taiwan

[73] Assignee: Hon Hai Precision Ind. Co., Ltd., Taipei Hsien, Taiwan

[ * ] Notice: This patent is subject to a terminal disclaimer.

[21] Appl. No.: 08/961,318

[22] Filed: Oct. 30, 1997

[30] Foreign Application Priority Data

Nov. 22, 1996 [TW] Taiwan ..... 85218083

[51] Int. Cl.[6] ..... H01R 13/648

[52] U.S. Cl. ..... 439/607

[58] Field of Search ..... 439/607, 609, 439/620, 885, 901

[56] References Cited

U.S. PATENT DOCUMENTS 4,974,075 11/1990 Nakajima ..... 439/607 X
4,983,127 1/1991 Kawai et al. ..... 439/79
5,175,928 1/1993 Grabbe ..... 439/885 X
5,676,569 10/1997 Davis ..... 439/731
5,769,666 6/1998 Wu ..... 439/620

*Primary Examiner*—Khiem Nguyen

[57] ABSTRACT

A USB receptacle electric connector consists of a dielectric housing, four conductive contacts and a shielding/grounding shell. The housing has an outer wall and a middle wall located within the outer wall defining four contact passageways. Each contact has a contact portion and a fitting portion received in a corresponding contact passageway, and a terminal portion extending perpendicular to and outside the housing for connection with a printed circuit board. The housing and the shell are dimensioned so that the shell is mounted inside the housing. When the shell is mounted inside the housing, it abuts an inner face of the outer wall of the housing, in which three locking tabs formed by tail portions of three side walls of the shell are fixedly engaged with the housing while middle portions of the three side walls are restrained in three channels defined by the housing. Furthermore, four outwardly and rearwardly protruding mounting tabs which are formed at a front end of the shell are fitted in four recesses defined in a front face of the outer wall of the housing.

11 Claims, 5 Drawing Sheets

UNIVERSAL SERIAL BUS RECEPTACLE ELECTRIC CONNECTOR

BACKGROUND OF THE INVENTION

1. Field of The Invention

The present invention relates to a USB electrical connector, particularly to a USB receptacle electric connector which has a dielectric housing receiving a number of contacts and an electromagnetic shielding/grounding shell mounted in the housing between the contacts and an outer wall of the housing.

2. The Prior Art

USB electrical connectors have been recently developed to replace a variety of I/O computer connectors for connection with various peripheral devices, for example, a mouse, keyboard, printer and scanner. A conventional USB electrical connector has a housing, a number of contacts mounted to the housing, and an electromagnetic shielding/grounding shell mounted to an outer face of the housing.

Such conventional USB connectors are disclosed in Taiwan Patent Application Nos. 77208107, 84213585, 84213586, 85210940 and 85210940.

To mount the shielding/grounding shell to the outer face of the housing, the shell must have a surface area larger than that of the outer face of the housing. Since the metal shell is more expensive to manufacture than the plastic housing, reduction of the surface area (and therefore the volume provided that the thickness is the same) of the shell will lower the manufacturing cost of the connector.

Furthermore, the shielding/grounding shells of the above mentioned prior art USB connectors cannot be easily mounted to the housing, and a front end of the shell may interfere with the removal of a mating connector from the connector.

Hence, there is a need for a USB electric connector to eliminate the above-mentioned defects of current USB electric connectors.

SUMMARY OF THE INVENTION

Accordingly, an objective of the present invention is to provide a USB receptacle electric connector which has a shielding/grounding shell mounted inside a dielectric housing receiving a number of contacts.

Another objective of the present invention is to provide a USB receptacle electric connector which has a shielding/grounding shell which can be easily mounted to a housing.

A further objective of the present invention is to provide a USB receptacle electric connector with a shielding/grounding shell having a front end which will not interfere with the removal of a mating connector from the USB receptacle electric connector.

To fulfill the above-mentioned objectives, according to an aspect of the present invention, a USB receptacle electric connector includes a dielectric housing with a generally rectangular configuration having an outer wall and a middle wall within the outer wall defining four contact passageways. Four contacts each have a contact portion and a fitting portion received in the corresponding contact passageway, and a terminal portion extending perpendicular to and outside the housing for connection to a printed circuit board. A shielding/grounding shell has a configuration similar to that of the housing and is dimensioned to be mountingly received in the housing. The shell is composed of a top, right side, left side and bottom wall which are each divided into a tail, middle and front portion. Each tail portion is formed with a locking tab and each front portion is formed with at least a mating connector engaging tab. When the shell is mounted into the housing, the shell abuts an inner face of the outer wall of the housing, the locking tabs fixedly engage with the housing and the middle portions of the top, right side and left side walls are respectively retained in three channels defined in the outer wall of the housing. Furthermore, four outwardly and rearwardly protruding mounting tabs formed at a front end of the shell are respectively fitted into four recesses defined in a front face of the housing.

DETAILED DESCRIPTION OF THE PREFERRED EMBODIMENT

Figure 1:
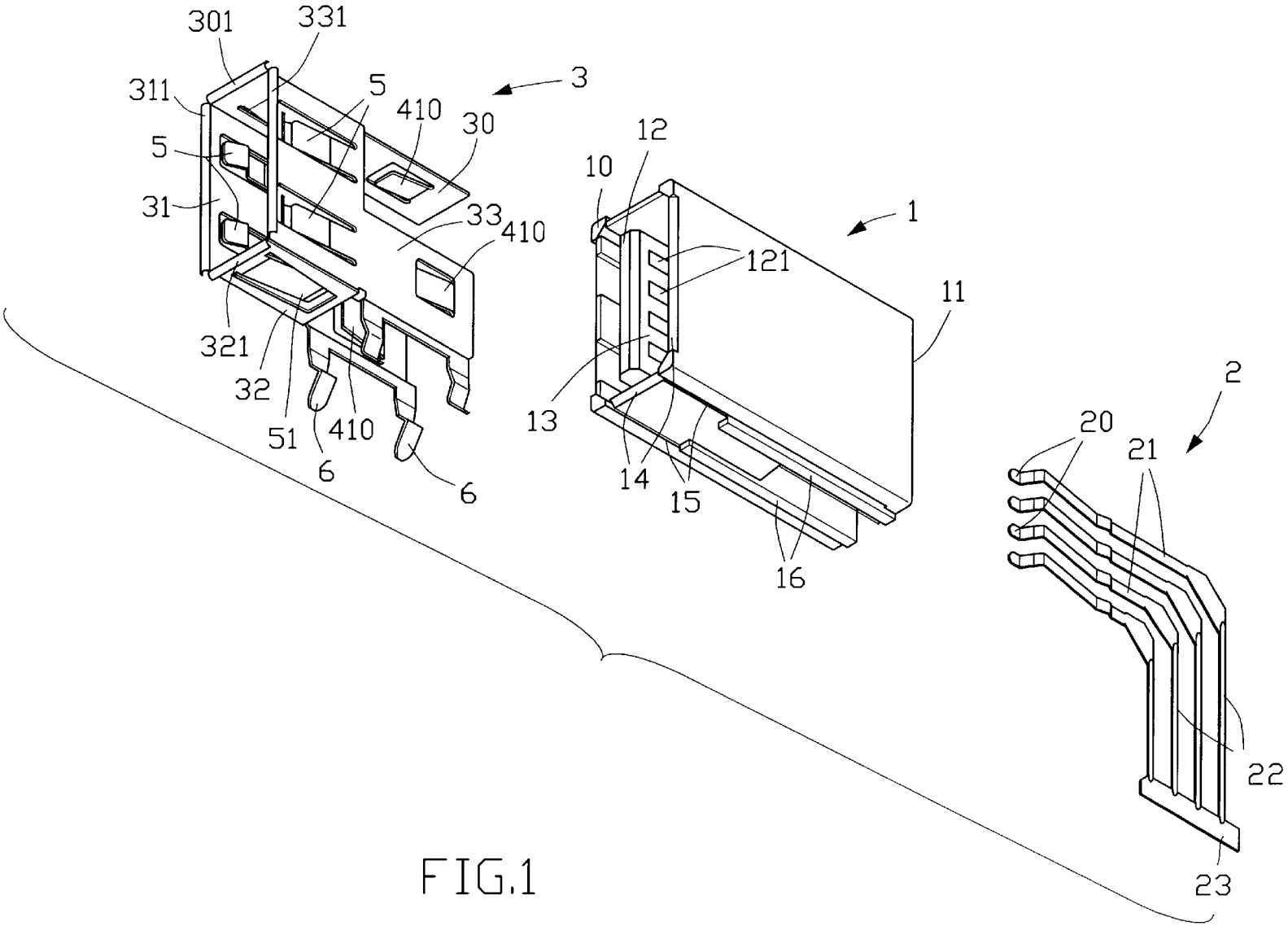
FIG. 1 is a perspective, exploded view showing components constituting a USB receptacle connector in accordance with the present invention.

The present invention will now be disclosed in detail with reference to the preferred embodiment as shown in FIGS. 1 to 5.

A USB receptacle connector in accordance with the present invention consists of a dielectric housing 1, a number of conductive contacts 2 and a shielding/grounding shell 3. The housing 1 has a rectangular configuration with an outer wall (not labeled) defining both a front face (not labeled) having four corners 10 for contacting with a mating USB plug electric connector (not shown) and a rear face 11 opposite the front face. A middle wall 12 within the outer wall defines four contact accommodating passageways 121. A front space 13 is defined between the outer wall and middle wall 12 so that the mating USB plug connector can be inserted into the receptacle connector in accordance with the present invention to create a mechanical and electric connection therewith. Four recesses 14 are defined between the four corners 10 of the front face of the outer wall. Two slits 15 are defined in a bottom part of the outer wall of the housing 1 from the front face toward the rear face 11 thereof. Two standoffs 16 are provided on a bottom face of the housing 1 between the slits 15. During attachment to a printed circuit board (PCB, not shown), the standoffs 16 space the bottom face from the PCB a distance, thereby preventing liquid solder from flowing into the dielectric housing 1 when the connector is soldered to the PCB.

Figure 2:
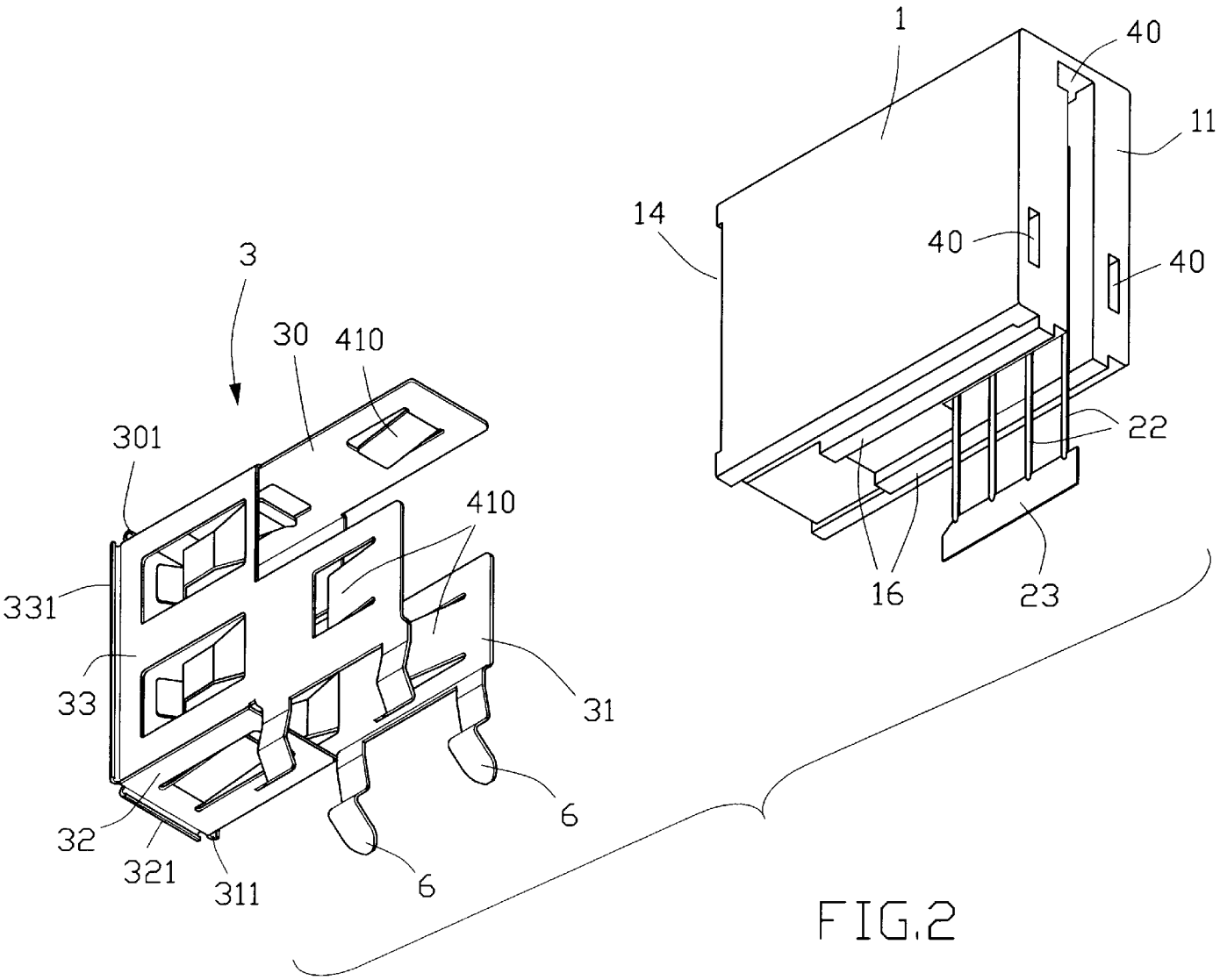
FIG. 2 is a view similar to FIG. 1, but with contacts mounted to a dielectric housing in accordance with the present invention.
Figure 3:
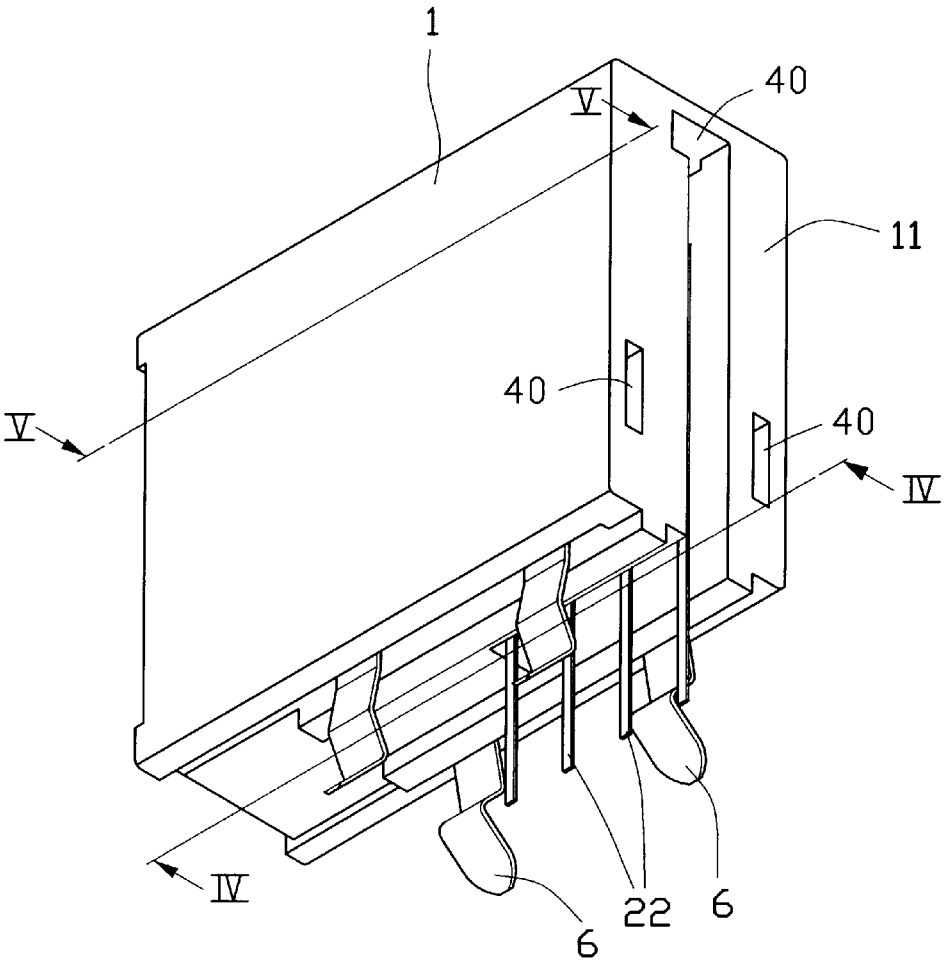
FIG. 3 is a perspective view showing the assembled components constituting the connector in accordance with the present invention.

The contacts 2 are received in the contact passageways 121. Each contact 2 includes a contact portion 20 for engaging with a corresponding contact of the mating connector, a fitting portion 21 for interferentially engaging with the middle wall 12, and a terminal portion 22 for being soldered to the PCB. FIGS. 1 and 2 show the contacts 2 connected to a blank 23 which will be cut from the contacts 2 after the connector is assembled, as shown in FIG. 3. Each contact portion 20 has an arced configuration and extends beyond the corresponding passageway 121 (best seen in FIG. 5) when the contacts 2 are mounted to the housing 1. Each terminal portion 22 is oriented substantially perpendicular to the corresponding contact portion 20 and fitting portion 21. Furthermore, the terminal portions 22 extend perpendicular to and outside the housing 1 when the contacts 2 are mounted to the housing 1 so that the terminal portions 22 can be soldered to the PCB.

The shielding/grounding shell 3 is made by stamping a metal sheet to form a top wall 30, a left wall 31, a bottom wall 32 and a right wall 33. The shell 3 has a configuration similar to the housing 1, but with a slightly smaller dimension so that it can be received inside of the housing 1 to abut an inner face (not labeled) of the outer wall of the housing 1. Four mounting tabs 301, 311, 321 and 331 are respectively formed at a front end of the four walls 30, 31, 32 and 33 of the shell 3 and protrude outwardly and rearwardly therefrom to define a flared front opening in the shell 3.

Each of the top, left and right walls 30, 31, 33 is formed with a tail portion (not labeled) having a locking tab 410 with a free end extending toward both the front end and an inside of the shell 3. The housing 1 further defines top, right and left locking tab receiving chambers 40 each opening to the rear face 11 of the housing 1 and communicating with the front face of the housing 1 via a channel 17 (best seen in FIGS. 4 and 5) having a dimension slightly larger than a thickness of the shell 3. The locking tab receiving chamber 40 and the channels 17 are formed by the outer wall of the housing 1. Moreover, two side mating connector engaging tabs 5 are formed by a front portion (not labeled) of each left and right wall 31, 33. An end mating connector engaging tab 51 is formed by a front portion (not labeled) of each top wall 30 and bottom wall 32. Each side engaging tab 5 has a free end extending toward the inside and front end of the shell 3. Each end engaging tab 51 has a free end extending toward the inside and a rear end of the shell 3. Two mounting legs 6 extend downward from a bottom edge of the tail portions of the left and right walls 31 and 33, respectively. The mounting legs 6 are used for mounting the connector to the PCB and connecting the shell 3 to a ground potential. The side and end mating connector engaging tabs 5, 51 are used for contacting with a shielding/grounding shell of a mating connector when it is connected with the connector in accordance with the present invention. Particularly referring to FIG. 4, a rear space 18 is defined between the middle wall 12 and the rear face 11 of the dielectric housing 1. A rear portion 19 of the middle wall 12 has a stairs-like cross-sectional view.

Figure 4:
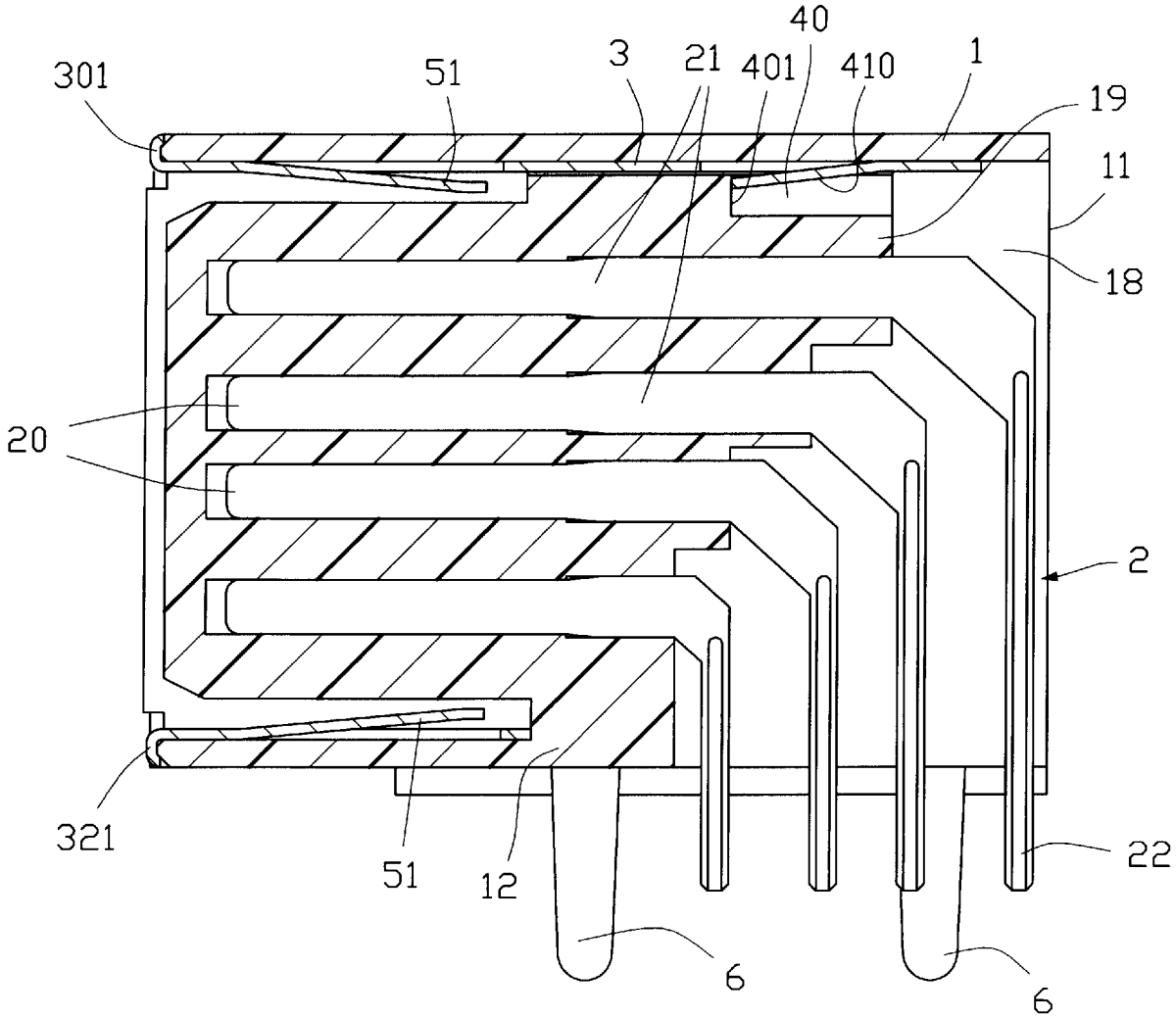
FIG. 4 is a cross-sectional view taken along line IV—IV of FIG. 3.
Figure 5:
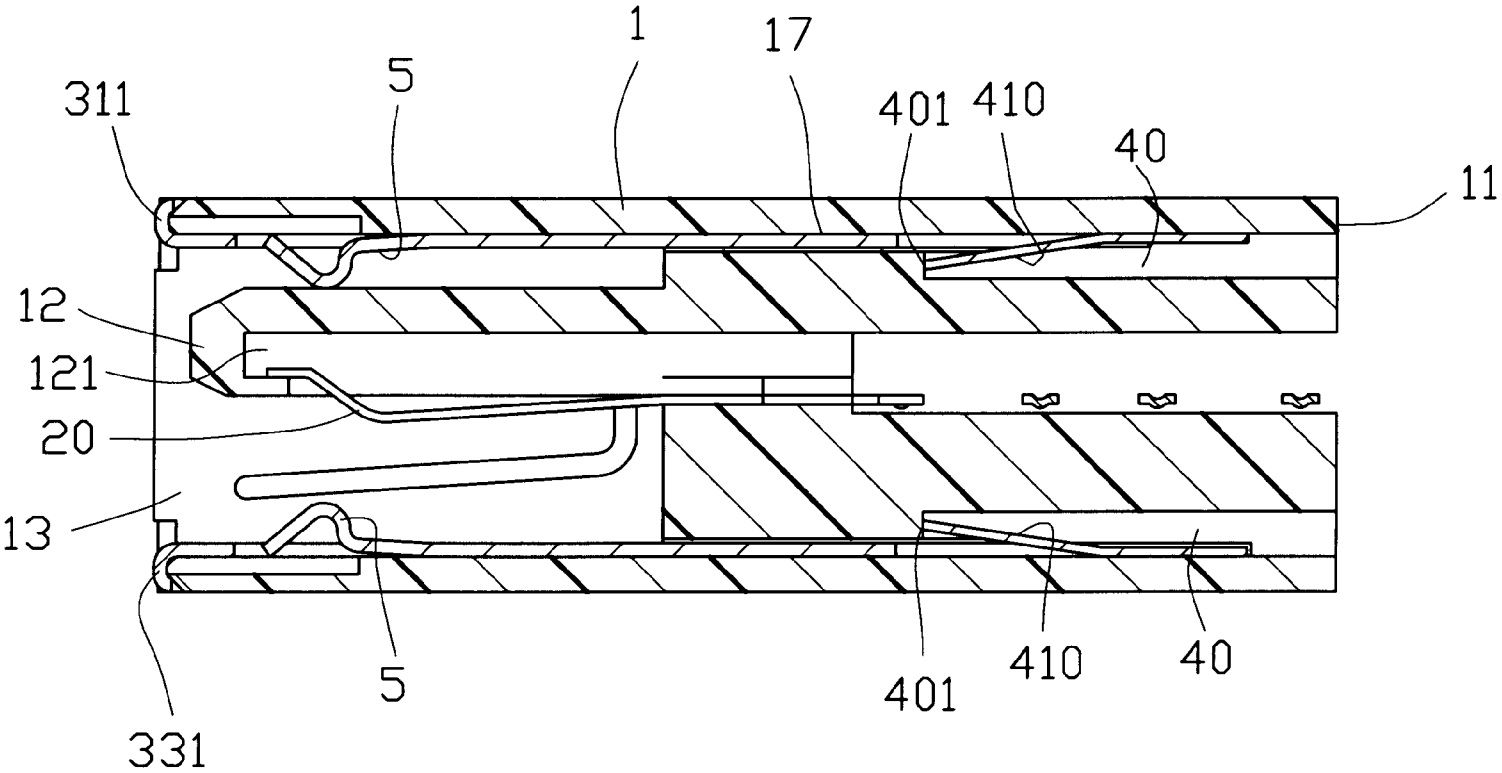
FIG. 5 is a cross-sectional view taken along line V—V of FIG. 3.

In assembly, the contacts 2 are mounted to the housing 1 to reach a position where the fitting portions 21 are interferentially fitted within the contact passageways 121 defined by the middle wall 12 and a front end of each contact 2 is retentively received within a front end of the middle wall 12 (best seen in FIG. 5). The terminal portions 22 of the contacts 2 extend downward beyond the bottom face of the housing 1 (best seen in FIG. 2) and the blank 23 is then cut from the terminal portions 22. Particularly referring to FIG. 4, a connecting portion (not labeled) of each contact 2 connecting the fitting portion 21 and the terminal portion 22 abuts a corresponding rear end of the stairs-like rear portion 19 of the middle wall 12, whereby the terminal portions 22 are spaced from each other an equal distance and aligned one another in one row along a front-to-end direction in said rear space 18.

Thereafter, the shielding/grounding shell 3 is mounted into the housing 1 by moving the tail portions of the top, left and right walls 30, 31 and 33 through the channels 17 and the legs 6 along the slits 15 to reach a locked position wherein the mounting tabs 301, 311, 321 and 331 are fittingly received in the recesses 14 and engage with the front face of the housing 1 between the four corners 10. When the shell 3 reaches the locked position, as shown in FIGS. 4 and 5, the free ends of the locking tabs 410 each abut a front inner periphery 401 of the chambers 40 and the engaging tabs 5 formed by the left wall 31 of the shell 3 engage with the middle wall 12 on a face opposite from a face defining the contact passageways 121. In addition, a middle portion (not labeled) of each top, left and right wall 30, 31 and 33 between the tail and front portions thereof is retained in a corresponding channel 17. Thus, the grounding/shielding shell 3 is fixedly mounted to the housing 1.

The above disclosures emphasize that the present invention does not require the use any tool to connect the shell with the housing 1. Pushing the shell 3 into the housing 1 easily accomplishes the assembly of the connector in accordance with the present invention.

Furthermore, since the shielding/grounding shell 3 is mounted inside the housing 1, the amount of material needed for forming the shell 3 is reduced, in comparison with a shell configured to be mounted outside the housing 1. Thus, the cost for manufacturing the connector is lowered.

Finally, since the mounting tabs 301, 311, 321 and 331 protrude outwardly and rearwardly, the front end of the shell 3 will not interfere with the removal of the mating connector from the connector in accordance with the present invention.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector, comprising:

a dielectric housing having an outer wall with a rectangular configuration having a front face for connecting with a mating connector, a rear face opposite the front face, a bottom face for connecting to a printed circuit board and a top face opposite the bottom face, and a middle wall with a plate-like configuration, said middle wall received within the outer wall and spaced therefrom a distance and defining a number of contact passageways on a first face thereof;

a number of conductive contacts each having a contact portion for connecting with a mating connector and a terminal portion for connecting with a printed circuit board, said contact portion being received in a corresponding contact passageway and said terminal portion extending beyond the bottom face of the housing; and an electromagnetic shielding/grounding shell having a substantially rectangular configuration, fixedly mounted inside the housing and abutting an inner face of the outer wall, said shell having a flared front end engaging with the front face of the housing, a middle portion retained within the outer wall of the housing and a rear portion defining a locking tab having a free end extending toward the front end of the shell and fixedly engaging with the outer wall of the housing.

2. The connector in accordance with claim 1, wherein the front face of the housing defines a recess and the flared front end of the shell is fittingly received in the recess.

3. The connector in accordance with claim 2, wherein the front face of the housing comprises four corners and wherein the recess is formed between the four corners.

4. The connector in accordance with claim 1, wherein the grounding/shielding shell comprises a top, bottom and two side walls, each of the top and two side walls having a tail portion forming a locking tab with a free end extending toward the front end and an inside of the shell and fixedly engaging the outer wall of the housing, and a middle portion retained in the outer wall of the housing, and a front portion defining a mating connector engaging tab for contacting with a mating connector when it is connected with the connector.

5. The connector in accordance with claim 4, wherein the mating connector engaging tab engages with the middle plate at a second face thereof, said second face being opposite to the first face of the middle wall.

6. The connector in accordance with claim 4, wherein the outer wall of the housing defines a top and two side locking tab accommodating chambers each opening to the rear face of the housing and communicating with the front face thereof via a channel having a dimension slightly larger than a thickness of the shell, and wherein the free ends of the locking tabs formed by the top and two side walls of the shell abut a front inner periphery of the top and two side chambers, respectively, and the middle portions of the top and two side walls of the shell are received in the respective channels.

7. The connector in accordance with claim 6, wherein the bottom face of the outer wall of the housing defines a slit from the front side of the housing toward the rear side thereof, and wherein the two side walls of the shell comprise a mounting leg extending downward from a bottom edge of one of the tail portions thereof, said mounting leg extending through the slit for fixing the connector to a printed circuit board.

8. The connector in accordance with claim 7, wherein the bottom face of the outer wall of the housing defines two slits and wherein two standoffs are formed on the bottom face of the outer wall of the housing between the two slits.

9. The connector in accordance with claim 1, wherein the terminal portion extends substantially perpendicular to the contact portion.

10. The connector in accordance with claim 1, wherein each contact has a front end remote from the terminal portion and in front of the contact portion, the front end of the contact being retentively received in a front end of the corresponding contact passageway defined in the middle wall.

11. An electric connector including an integrally formed dielectric housing defining a plurality of passageways disposed on a same vertical plane receiving therein a corresponding number of contacts, wherein front ends of said passageways are positioned in a middle wall of the housing extending within a first space surrounded by outer walls of the housing, and rear ends of said passageways communicate with a second space defined in front of a rear face of the housing, and wherein a rear portion of the housing includes a stair-shaped cross-section and tails of said contacts are aligned in one row in a front-to-rear direction of said second space.

* * * * *